US009301553B1

(12) United States Patent
Donovan

(10) Patent No.: US 9,301,553 B1
(45) Date of Patent: Apr. 5, 2016

(54) SEPARATING LINED TIGHTS/THIGH-HIGH LEGWARMERS

(71) Applicant: MaryEllen F. Donovan, Ridgefield, CT (US)

(72) Inventor: MaryEllen F. Donovan, Ridgefield, CT (US)

( * ) Notice: Subject to any disclaimer, the term of this patent is extended or adjusted under 35 U.S.C. 154(b) by 220 days.

(21) Appl. No.: 13/650,027

(22) Filed: Oct. 11, 2012

Related U.S. Application Data

(60) Provisional application No. 61/545,622, filed on Oct. 11, 2011.

(51) Int. Cl.
*A41D 1/00* (2006.01)
*A41D 17/02* (2006.01)
*A41D 17/00* (2006.01)

(52) U.S. Cl.
CPC *A41D 1/00* (2013.01); *A41D 17/02* (2013.01); *A41D 17/005* (2013.01)

(58) Field of Classification Search
CPC ..... A41D 17/00; A41D 17/004; A41D 17/02
USPC ..... 2/242, 61, 62, 22, 23; 36/2 R
See application file for complete search history.

(56) References Cited

U.S. PATENT DOCUMENTS

| | | | | | |
|---|---|---|---|---|---|
| 269,479 | A | * | 12/1882 | Stretch et al. | 2/227 |
| 1,620,743 | A | * | 3/1927 | Stuart | 36/2 R |
| 1,678,954 | A | * | 7/1928 | Rauh | 36/2 R |
| 1,708,144 | A | * | 4/1929 | Martin | 36/2 R |
| 1,708,810 | A | * | 4/1929 | Vrabek | 2/242 |
| 1,782,504 | A | * | 11/1930 | Erhardt | 36/2 R |
| D108,342 | S | * | 2/1938 | Morrison | D2/901 |
| 2,125,451 | A | * | 8/1938 | Kolliner | 36/2 R |
| 2,159,119 | A | * | 5/1939 | Allen | 36/2 R |
| 2,246,100 | A | * | 6/1941 | Marzani | 54/82 |
| 2,431,287 | A | * | 11/1947 | Washington | 2/239 |
| 2,459,352 | A | * | 1/1949 | Williams | 2/69 |
| 3,074,405 | A | * | 1/1963 | Duensing | 604/312 |
| 3,083,373 | A | * | 4/1963 | Rizzotto | 2/270 |
| 3,193,984 | A | * | 7/1965 | Schubert | 54/82 |
| 4,382,301 | A | * | 5/1983 | Hightower, Jr. | 2/22 |
| 4,586,272 | A | * | 5/1986 | Forster | 36/2 R |
| D290,302 | S | * | 6/1987 | Campbell | D2/901 |
| 4,766,613 | A | * | 8/1988 | Wells | 2/227 |
| 5,010,597 | A | * | 4/1991 | Glover | 2/242 |
| 5,033,126 | A | * | 7/1991 | Wruck et al. | 2/242 |
| 5,173,967 | A | * | 12/1992 | Carter | 2/242 |
| 5,363,632 | A | * | 11/1994 | Armato | 54/82 |
| 5,608,915 | A | * | 3/1997 | Libit | 2/228 |
| 6,158,056 | A | * | 12/2000 | Riley | 2/269 |

(Continued)

*Primary Examiner* — Richale Quinn
(74) *Attorney, Agent, or Firm* — Andrew S. Langsam; Pryor Cashman LLP

(57) ABSTRACT

A composite leg-covering garment comprising exterior fabric and interior insulative fabric. Opposed peripheral edges can be fastened to form a tubular configuration wrapping tightly around the leg to provide the look of tights, the warmth of leggings and, yet, the ease of donning and removal of break-away pants. The opposed edges are joinable by a single zipper running either the entire length or substantially the entire length of the garment. Preferably an elastic thigh cuff is located along the upper edge of the garment and an elastic ankle cuff provided at the bottom. Alternatively, two zippers are provided, one from the ankle up to almost the thigh cuff and the other from the thigh cuff down, the zippers being on opposite sides of the garment. The extension of the two zippers overlaps along the length of the garment. The leg-coverings can attach to a pair of shorts.

3 Claims, 7 Drawing Sheets

(56) References Cited

U.S. PATENT DOCUMENTS

| | | | | |
|---|---|---|---|---|
| 6,185,752 | B1 * | 2/2001 | Hendersen et al. | 2/242 |
| 6,205,593 | B1 * | 3/2001 | Schaub, Jr. | 2/242 |
| D516,256 | S * | 2/2006 | Dymburt | D30/145 |
| D519,719 | S * | 5/2006 | Perkins | D2/901 |
| 2005/0215935 | A1 * | 9/2005 | Ritter | 602/65 |
| 2009/0216305 | A1 * | 8/2009 | Bonner | 607/108 |

* cited by examiner

SEPARATING LINED TIGHTS/THIGH-HIGH LEGWARMERS

RELATED APPLICATIONS

This application claims priority on U.S. Provisional Application No. 61/545,622, filed Oct. 11, 2011. All description, drawings and teachings set forth therein are expressly incorporated by reference herein and I claim priority upon the teachings expressly made therein.

FIELD OF THE INVENTION

The present invention relates to a leg-covering set of garments for young women, boys, girls, men and women, and athletes, etc. which combines the benefits of break-away athletic warm-up pants, the warmth of traditional leg warmers, the leg coverage of leggings, and the professional look of tights. Yet, the present invention is extremely easy to put on and take off, as desired. A preferred embodiment of the present invention is disclosed—thigh-high leg warmers—which can be used alone or in a combination with a pair of shorts. Several embodiments are disclosed and within the contemplation of the inventor, many of which comprise similar features, namely a warm garment (actually a pair of garments comprising a set of such for a two-legged person) for use underneath a skirt, dress, or jumper which can be quickly and easily unzipped or unsnapped for easy removal, but which is fitted, stretchy and attractive to wear with skirts, dresses, etc., and preserves the look of tights and the warmth of leg warmers until removed.

BACKGROUND OF THE INVENTION AND DISCLOSURE

In cold winter environments when girls wish to, or are required to, wear jumpers/skirts to parochial or secular school, there is a need to protect their legs from the cold and keep them warm. Yet, to do so in an attractive manner, comfortably, and to permit easy donning and removal is important. Similar concerns are present in other environments, too, i.e. getting ready for a dance recital, for an athletic event, etc. Keeping the legs warm, from ankle up to the top of the thighs, is highly desirable and, yet, removal of the garment keeping the legs warm, in a minimal amount of time and with ease, and without going to a place of seclusion for the removal is very important, too. Heavy wool tights offer protection outdoors, but are uncomfortably warm for extended wear indoors. Pants worn under jumpers/skirts can provide some protection, but can look sloppy and can be difficult to remove (and often an adult is needed to help remove the pants when they are worn by a child), and they are often not permitted in conjunction with a school uniform. Finally, leggings worn underneath a skirt or dress look neat, but provide little warmth during cold weather, and are still difficult to remove without the assistance of an adult and/or the removal of shoes.

Accordingly, there is a need for a legwarmer-like garment that can protect and warm users' legs which allows a user to maintain a neat look, while simultaneously being easily removed even by a child without the assistance of an adult and/or the removal of shoes. There is a need for such a garment to provide selective warmth to the legs which can be easily and quickly removable, without sequestration, which garment does not necessarily also cover the lower torso or pelvic area of the user. Yet, in an alternate embodiment, the leg coverings of the present invention can be attached to and thus be integrated with a lower torso-covering pair of shorts to provide overall and consistent warmth to the lower part of the body and, yet, when desired the leg covering portions can be detached from the shorts and removed for comfort and "look" and, yet, the shorts maintained for warmth and reattachment of the leg coverings when and as desired.

The leg covering garment primarily suited for young girls presented herein has preferably the aesthetic quality and appearance of cable knit or sweater knit tights. Of course, other patterns can be used, too, e.g., ribbing, patterns, etc. They preferably have an outer lining made of cable knit, ribbed knit, sweater knit, or any type of material that looks like tights, while also having an inner lining made of stretch fleece, jersey knit, brushed terry, or another material which provides a tight fit and warmth. The exterior could even be waterproof, too. The leg-covering garments are preferably easily donned and removable even for young girls to put on and take off without removing their shoes. Removal and donning is done without removal of any lower torso or pelvic area-covering clothes, i.e. a skirt, tights, underwear, etc., and yet the present invention can be placed on and easily removed with or without the shorts component, if used by the wearer. The purpose of the present invention is to provide an attractive additional layer of leg warmth during cold weather for young girls wearing skirts or dresses (or any article of clothing that exposes at least part of their legs) that is easy to take off when indoors and to put on when going back outside, without removing shoes and without necessitating an extra layer being provided to the lower torso (although in one embodiment the leg garments disclosed herein are useful in conjunction with a pair of mating shorts. However, in that embodiment, the shorts (covering the lower torso) will remain in place and the leg warming garment portions removable and reattachable, as desired.

A preferred embodiment of the inventive legwarmer has an exterior fabric integrated or joined to an interior fabric, with an elasticized thigh-located cuff. The two layers are connected along their upper edges by the thigh cuff, preferably by conventional sewing, adhesive, fusing, etc., and they may be also connected along the lower edges by an ankle cuff. Preferably, a zipper is vertically provided and located along the lateral edges of the garment (when flat) and preferably extends from the bottom of the ankle cuff to the top of the thigh cuff. Thus, the zipper can be zipped and thereby convert the double layer of material from its flat condition to a tubular condition which is wrapped around the user's leg.

In another preferred embodiment of the invention two zippers are provided, one extending down from the thigh cuff but only a portion of the overall length of the leg warmer, i.e., not all the way down to and through the ankle cuff and the other zipper, located around the garment from the first zipper, but extending up from the ankle cuff substantially extends the entire height of the garment but not entirely extends from top to bottom. This large zipper along with the small zipper extending down from the thigh cuff are of a combined length greater than the length of the garment. When both zippers are unzipped, the garment can easily be slipped on and over a foot and shoe for both donning and removal.

Other embodiments are provided, too, e.g., a single zipper extending substantially the entire length but not through the elastic thigh cuff; a pair of zippers either vertically aligned or not, which defines a central tubular section which is sufficiently stretchy to allow for donning and removal, as desired, etc.

In the embodiment with a single zipper not extending entirely from top to bottom or a pair of opposed zippers, each extending toward the other but only for a portion of the overall length of the leg warmer, i.e., not all the way through the leg warmer, it is considered not fully "separating" nor capable of getting into a fully, flat condition. The fully separating single zipper (with one or two slides for the opening and closing of the same zipper) option for the inventive leg warmers is within the scope of the invention and may be easier to manipulate for some age groups of wearers while the two zipper or partial-separating versions may be easier to manipulate (for donning and removal) for other age groups. Manual dexterity and body shape also come into play in selecting which of the versions of the invention are best suited for the particular individual.

There are two preferred embodiments of the present inventive leg covering garments. The first is a stand-alone thigh-high set of legwarmers (and that embodiment can take the form of a single fully separating zipper, extending from the ankle area or cuff up either through the thigh cuff or up to the elastic thigh cuff OR a pair of partially separating zippers, one from the ankle area or cuff extending upwardly close to the thigh cuff and another zipper, not vertically aligned with the first zipper but preferably about 180 degrees around from it and extending down from the thigh cuff but only a short distance; the total length of the two zippers being greater than the overall height of the garment—and the second embodiment is a connectable pair of shorts with the legwarmers to form tights. The present invention is preferably body hugging and fitted on the legs like a pair of tights (i.e. not slouchy 1980's-style calf leg warmers) and ideally has one or more zippers that allow a wearer to easily and quickly remove them without taking off shoes and without removing torso-engaging underwear or pants. In one embodiment, the pair of leg-covering garments have elasticized cuffs at the thigh that expand enough to slip over and off around the shoes, but the cuff is elastic/resilient enough, i.e. has enough stretch and elasticity to keep the legwarmers in place and prevent them from sliding down. In another embodiment, the leg-covering inventive garment has a self-sizing mechanism—a preferably elastic band with a button hole, the band being sewn into the thigh cuff (at the back) which can be suitably stretched and buttoned to one of the buttons on the front of the leg warmer to get the proper fit about the thigh. In one embodiment, the thigh-high, removable leg warmers function alone. In another embodiment, they cooperate with the bottom edges or cuffs of the legs of a pair of shorts to help keep them up and to provide even more body warmth.

The second embodiment of the present invention provides substantially the same design for a leg-covering garment as described in the first embodiment, but also preferably includes fitted shorts (or a torso covering section) that the leg portions attach to and detach from. This embodiment is similar to a combination of normal, commonly-known leggings and windbreaker or warm-up pants, where the bottom leg portion can be horizontally unzipped and removed. However, the leg portion on these garments is easily removed from the shorts via a child-friendly attachment mechanism, buttons on the leg warming garment and button holes at the cuffs of the shorts, for example, allowing for selective removal of the leg portion without passing the garment over the feet and shoes (in the single fully separating embodiment) or allowing easy passage of the foot and shoe through an opening in the leg warmer garment (in the embodiment where two, non-aligned, vertically oriented zippers are provided to allow the device to be donned and removed from the wearer's legs.

In the preferred embodiment, the attachment mechanism between shorts and leg warming garment(s) is a button on the thigh cuff and a corresponding buttonhole on the bottom edge of a cuff of the shorts. However, other attachment means, such as snaps or Velcro, are also envisioned. This version allows the wearer to maintain the shorts portion, while removing the leg portions when indoors. The shorts part of this embodiment allow the user to maintain the benefit of that portion of the warmth of the garment, but at the same time the shorts can be covered and hidden by the skirt or dress being worn. Here, too, the leg warmer portions are easily and quickly donned and removed by the vertical zipper, Velcro, or other holding mechanism without passing over the shoes (in the fully separating, one-zipper embodiment) or passing over the foot and shoe (in the two zipper, non-aligned, substantially vertical zipper version). The present invention also differs from other pants in appearance while still being attractive and providing warmth. They are fitted to the legs and look like tights-plus the shorts that remain on the wearer (in that embodiment) will not have a zippered edge that could be uncomfortable for the wearer. The shorts of the present invention are substantially regular shorts with button holes on the cuffs, plus the leg warmer garment portions themselves can be worn by themselves, i.e., without the shorts or integrated and connected to the shorts.

The present invention is designed to be easily removable, likely when a user is indoors. Therefore, one or more zippers are preferably provided so that the leg section can not only be detached from the shorts in that embodiment, but also so that, in any embodiment, it can be unzipped from its full tubular shape to be removed without requiring the user to take off whatever article of footwear is being worn at the time. In one preferred embodiment, one fully-separating zipper is utilized. For this connection, "fully separating" means converting the tubular legwarmer into a flat condition while "partially separating" means to retain at least a portion of the leg warmer in a tubular condition, yet still allowing ease of donning and removal. Full separation allows the garment to be fully unzipped and removed without passing over the feet. In the two zipper embodiment, the two zippers are not aligned and preferably are located 180 degrees around from one another. One zipper extends upwardly from the ankle area and almost through (but not through) the top of the garment, i.e., it terminates near to the top or thigh area. The other zipper extends downwardly from the thigh towards the ankle area, but only extends a short distance down. When both zippers are open, the circumference and/or elasticity in the area of the ends of the zippers provides a wide enough opening for the foot, with a shoe to pass therethrough. In this preferred embodiment, the combined length of the ankle-up zipper and that of the thigh-down zipper is greater than the overall length of the leg warming garment, so that some overlay of zippers is provided. Preferably, the ankle-up zipper is far greater in length than the thigh-down zipper but other dimensions and lengths may be used.

In the two zipper embodiment, one or more partially separating (i.e., a section of the height or length from ankle to thigh is always tubular i.e., will not lay flat like the fully separating embodiment with a single zipper) when the zippers are fully unzipped. Instead, the elasticity allows removal over the feet and shoes. If one partially-separating zipper is used, it preferably unzips from the ankle up and the thigh cuff is sufficiently elastic to allow the foot and shoe to pass through it without difficulty. If more than one partially-separating zippers is used, one preferably unzips from the ankle cuff up while another zipper preferably unzips from the thigh cuff down. In a preferred embodiment, the two zippers can be located on opposite sides of the leg warmers and can extend vertically past one another. In another embodiment (where the zippers do not overlap) approximately only a few inches of material is left between the two zippers, thus achieving the benefit of being easily removable when the two zippers are unzipped towards one another, by a user pulling the garment down around the foot and whatever shoes are worn, but while maintaining a small section of tubular length for ease of re-zipping and putting the leg warmers back on when they are desired to be worn. In this partially separated embodiment, the ever-present tubular sections can be located at or about the knee (about ½ the height of the leg warmer) so that zipping up for donning and unzipping can be easily done, even while sitting down. Also, in this partially separating embodiment, with two zippers coming close to the top and bottom of the knee, the tubular leg warmer can be further enlarged in size (to accommodate the knee and removal over the shoe) or made of elastic material (as the thigh high cuff) to allow easy placement and removal over the shoe of the wearer. One zipper unzips up (from ankle cuff towards the knee) and the other zipper (located around on the other side of the leg warmer) zips down (from the thigh cuff towards the knee). The elasticity of the garment, at the location of the ends of the zipper provides the opening for the foot, with a shoe.

The garment, when secured around a user's leg, should fit snuggly, in the same manner as tights do. Accordingly, the exterior fabric and the interior fabric may be stretch fabrics and/or the garment may be suitably shaped and tapered. For example, the exterior fabric may be a knit fabric such as cable knit or ribbed knit fabric. Additionally, the exterior fabric may be water-resistant and anti-pilling. The interior fabric, on the other hand, may be a 2- or 4-way stretch fabric (e.g., a stretch fleece, jersey knit, brushed terry fabric, etc.). The interior fabric is preferably tight-fitting, warm, and comfortable (e.g., tactile comfort) and preferably moisture wicking. The overall garment is preferably machine washable and durable.

A preferably-elastic thigh cuff (comprised of one or more elastic bands or merely the elasticity of the top of the garment, when doubled up at the top to form a cuff) is provided at the top of the legwarmer and preferably fits snuggly about the user's thigh, so that it remains in place when worn. The thigh cuff preferably includes an elastic band with a button hole that stretches and attaches at the optimum length to one or more circumferentially spaced buttons on the cuff (at the front of the leg warmer garment) to provide a tight, comfortable fit. In one embodiment, the thigh cuff is shorter in circumferential length than the joined fabrics to facilitate a snug fit to the thigh. In the preferred embodiment, the self-sizing elastic band mechanism is provided. The thigh cuff can be just as wide, less wide, or wider than the exterior and/or interior fabric located just below but the thigh cuff should hold the leg warmer garment up and upon the thigh of the wearer. The thigh cuff can be elasticized with several bands and cinch in when lain flat (i.e., when not worn) but the overall aesthetic look is not as desirable as the other embodiments.

In the preferred embodiment, the garment is tapered proportionately, like the pant legs of tapered jeans or leggings, for example, and the sizing and tightening of the thigh section along with the elasticity of the fabrics for the entire length of the garment are all that is needed to maintain the same, snug around the leg and up upon the thigh. In the preferred embodiment, an ankle cuff is also provided but it is not required. It can be similar to the thigh cuff. The fabric employed for the exterior and interior layers provide, generally, sufficient elasticity for the ankle cuff and thus no elastic band(s) nor self-sizing elastic band with button holes and buttons is provided. It is "elastic" in the sense that it stretches around the ankle and is held there, but it doesn't necessarily require an elastic band, separate from the fabric used for the interior and exterior fabrics.

One or more zippers (in the fully or partially separating embodiments, respectively) preferably join the otherwise free lateral edges of the leg warmers or garment and when fastened, also hold the garment about a user's leg. If one zipper is used, the zipper preferably extends from the lowermost edge of the ankle cuff to the uppermost edge of the thigh cuff. In the two zipper or partially separating embodiment, the bottom zipper extends substantially up from the ankle cuff towards the thigh cuff while the top zipper, not-aligned (preferably 180 degrees around) and extending down from the thigh cuff towards the ankle cuff is provided. The zippers, when unzipped, allow for donning and removal of the garment while the single zipper, in the fully separating embodiment, will fully separate the leg warmer into a flat layered fabric and that is easy to remove from the leg of the wearer. In the case of the partially-separating embodiment, a small amount of tubular material is present, even after unzipping the zippers but an opening is provided, with elasticity, sufficient to allow the foot and attached shoe, to pass therethrough.

Alternatively, the zipper(s) may be replaced with hook and loop fasteners, buttons and buttonholes, tabs and slots, buckles, etc., or a combination thereof. Additionally, a pair of fitted shorts may be included as an element of the garment. The leg portions of the leg warming garment could be fastened to the bottom edge of the shorts with buttons of the leg warmers passing through button holes of the cuffs of the shorts, or zippers, hook and loop fasteners, etc., or a combination thereof can be employed although not believed as comfortable as the button-buttonhole embodiment. In any event, the overall effect being like leggings or tights when fastened to shorts or, if no shorts are employed, thigh-high leggings or tights which are warm and cover the legs but very easy and quick to don and remove. The once-joined fabric (in the embodiment of the leg sections using a fully separating zipper) form a leg-encircling tube and may be fastened to the shorts at the thigh cuff. The partially separating zippers, however, also can be integrated to the shorts, in the same manner.

In one embodiment, there is provided a substantially vertical zipper which when unzipped fully separates the tube into a flat multiple layered garment. In the partially separating embodiment, where either one zipper is used which extends up to but not through the thigh cuff or a pair of opposed, yet non-aligned zippers are used, the leg warmers can be used by themselves or in conjunction with a pair of shorts. In the embodiment where two zippers are provided and not aligned, preferably, they are 180 degrees around from one another. In this embodiment, the zippers actually extend beyond one another so that the zipper commencing at the top of the thigh extends and zips and unzips down to a point below where the zipper extending up from the ankle cuff extends upwardly. Thus, in this embodiment, an overlap of zipper ends is provided and that defines an opening allowing for slipping the foot (even with a shoe thereon) therethrough for allowing ease of donning and removal.

The present invention is unique because the wrap around or slide on and off leg warmers described herein combine the concepts of breakaway athletic warm-up pants, leg warmers, tights and leggings, but differs from each enough to present a new and non-obvious product. It is similar to breakaway athletic warm-up pants (e.g. pro basketball players remove their warm-up pants without taking off their sneakers) but is also fitted, stretchy and attractive to wear with skirts or dresses in a professional environment and preserves the look of tights so that a user doesn't have to wear a pair of pants or a lower torso covering section underneath a skirt for warmth or for holding the leg warming portions. Athletic breakaway pants include an integrated lower torso engaging section with the leg sections. The present invention does not. Stated differently, breakaway basketball pants separate from the waist down to the ankle so that the pants themselves entirely break away and no shorts remain on the athlete. The present invention, even when the leg warmer sections are removed (after detaching from the shorts) leaves the shorts on the wearer and, in addition, as an alternative to reattaching to the shorts, allows for the wearing of the leg portions on their own.

The present invention is also similar to leg warmers in function, but provides substantially better coverage (i.e. covers the full leg, while conventional leg warmers generally cover just below the knee), stays in place (by use of a stretchy interior lining, stretchy exterior fabric and a thigh cuff area with a self-sizing elastic band of elasticity) by hugging the length of the leg and therefore does not slide down nor bunch up in the middle. The present invention provides additional warmth via the interior fabric and maintains an attractive outside appearance.

Finally, the present invention is fitted like tights and leggings, but is not a pair of pull-up pants or tights which require the removal of shoes to be put on or removed. It provides leg warmth without an extra lower torso covering section (while providing the flexibility of wearing the leg coverings alone, with or without shorts, but if with shorts, allows for removing the covering portions from the shorts and allows for leaving the shorts on the wearer). The one or more zippers along the peripheral lateral edges of the fabric make the present invention easy to put on and take off even with shoes intact. In one embodiment, a pair of shorts is provided and remains on the wearer after the leg portions are selectively removed, thus providing flexibility for the wearer, maintained warmth of the upper thighs, and ease in the changing process. Alternatively, in the preferred embodiment, the leg portions can be worn without the shorts.

While the foregoing embodiments are directed for use primarily by young children and those required to wear school uniforms (or outfits) or by a woman wearing a skirt or dress in a professional environment, it is envisioned that the present invention could be adapted for other individuals (athletes, dancers, etc.) of other ages and in other situations, as well. For example, in a sporting environment, the garment could be worn during warm-ups and easily removed prior to an event or match.

The present invention may be embodied in other forms without departing from the spirit and the essential attributes thereof, and, accordingly, reference should be made to the appended claims, rather than to the foregoing specification, as indicating the scope of the invention.

DESCRIPTION OF PRIOR ART

To the Inventor's knowledge, no prior art exists which combines the beneficial features of breakaway athletic warm-up pants, leg warmers, tights, and leggings, while providing substantial changes from and improvements to each. While the prior art types of leg garments have advantages, there is a need for a garment which provides an attractive and professional look (which athletic break-away pants and conventional slide on leg warmers do not) for use in a professional or more formal environment, such as school or work, which provides warmth for a wearer's legs in the wintertime (for which traditional leggings do not provide) and which covers the entire leg (which leg warmers do not) while simultaneously being easily removable without removal of shoes (which tights do not provide) and without necessarily being secured or integrated to a lower torso covering garment (in contrast to athletic warm-up pants).

SUMMARY OF THE INVENTION

A leg-covering garment is disclosed, comprising an interior and exterior fabric (sewn together about their outside edges) each having a surface area, a pair of opposed peripheral or side edge portions with an upper edge portion and a generally parallel and opposed lower edge portion. The interior fabric is secured to the exterior fabric by sewing or other means and has a stretchably woven-like surface area. The exterior fabric and the interior fabric have substantially equivalent surface areas, preferably either forming a substantially rectangular or tapered leg garment shape (like the leg of a pair of pants when the vertical seam is removed). Preferably, the leg portions are tapered so that the ankle is narrower than the thigh—looking like a tapered polygon in the fully separating (and laid flat) condition; yet resembling a tapered tube when worn on the wearer's leg. The opposed edges can be joined together around their respective edges by a vertical zipper. A thigh cuff is preferably provided. The thigh cuff is preferably elastic and, in its relaxed position, has a height of a few inches and can be formed from a mere foldover of the top of the garment. The thigh cuff is stretchy from the fabric itself and it may have a self-sizing elastic band. An ankle cuff is similarly affixed or formed by folding over the joined exterior and interior fabrics along their lower edge portions (and on the opposite end as the thigh cuff). One zipper is provided for releasably joining together the opposed vertical or lateral edges to form a tubular garment. The zipper runs up from the bottom of the ankle cuff. In one embodiment it fully separates the tube into a lie-flat condition, i.e., the zipper fully extends along the full length of the garment. In another embodiment, the zipper only extends from the ankle cuff to the thigh cuff (but not through the thigh cuff) and, in this embodiment, the elasticity of the thigh cuff is sufficient to allow the garment to be easily donned and removed, as desired, over the foot and shoe. Or, the garment can be provided with a pair of opposed (one starting at the ankle-one starting at the thigh) yet non-aligned zippers which overlap one another in the vertical dimension such that unzipping of the zippers defines an opening through which the foot and shoe may easily pass. In the first embodiment using one zipper (the fully separating embodiment) the entire leg warmer converts from a tubular shape to a flat condition. Here, the zipper extends the full height of the leg warmer even through the elastic thigh cuff.

Two preferred embodiments of the leg-covering garment are presented—a thigh-high legwarmer and a set of the same attachable to a lower torso covering garment or a pair of shorts, similar when the leg warmers are attached to the shorts to the warmth and look of a set of tights. The latter version of the leg warmer garment can also include an attachment means for securing the upper edges of the thigh cuff to the bottom cuff of the leg-encircling portion of the shorts.

DETAILED DESCRIPTION OF THE DRAWINGS AND THE PREFERRED EMBODIMENT

Description will now be given of the invention with reference to the attached FIGS. 1-5. It should be understood that these figures are exemplary in nature and in no way serve to limit the scope of the invention as the invention will be defined by the claims, as interpreted by the Courts.

Figure 1:
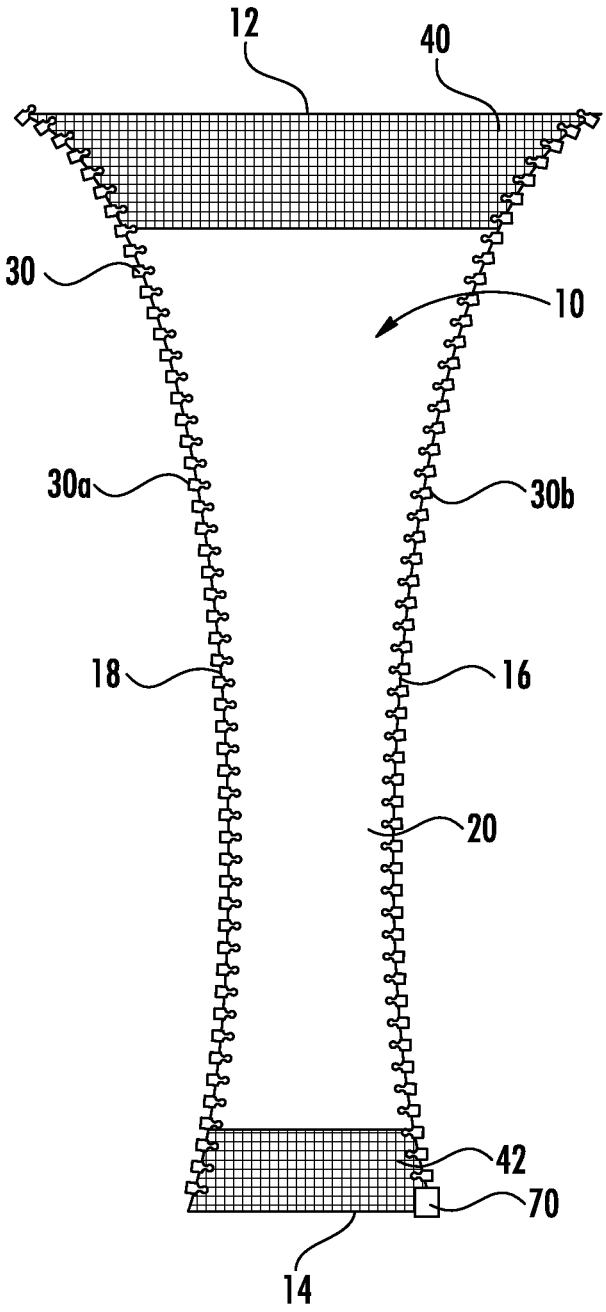
FIG. 1 is a top view of one embodiment of the present invention, showing the exterior of a leg-covering garment for young girls or women when unzipped and in its open (non-tubular) configuration. The elastic cuffs are at the top (for the thigh) and at bottom (for the ankle)
Figure 2:
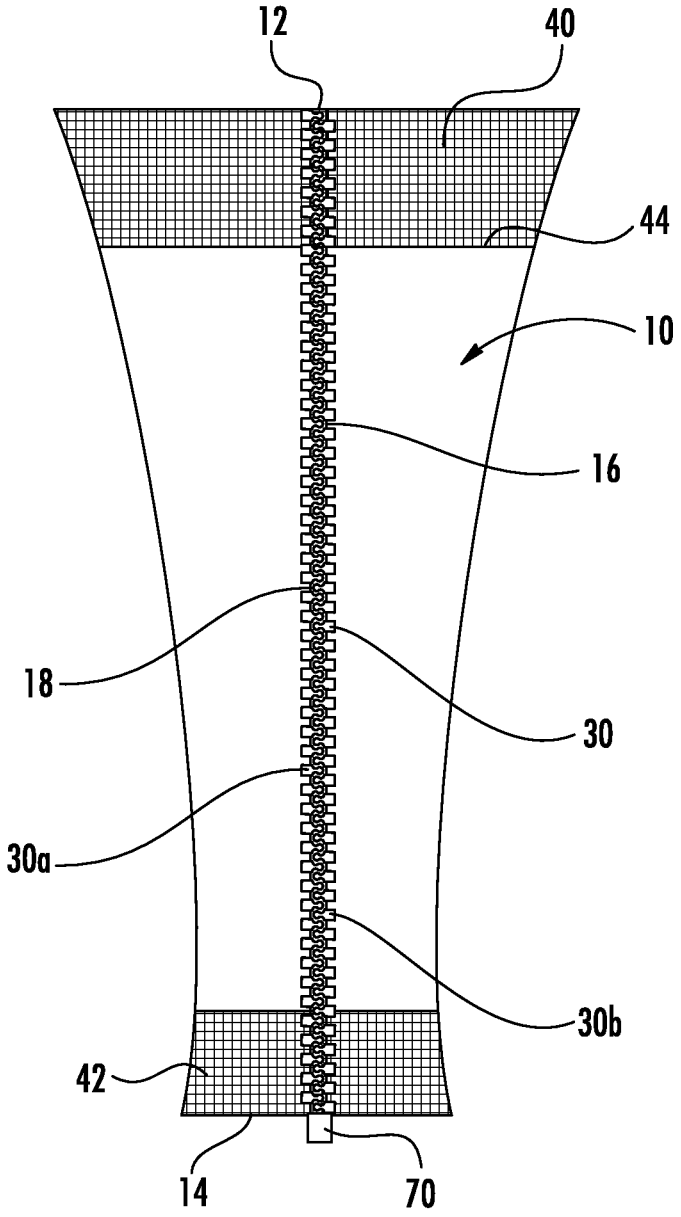
FIG. 2 is a top view of the present invention in its closed (or tubular) configuration.
Figure 3:
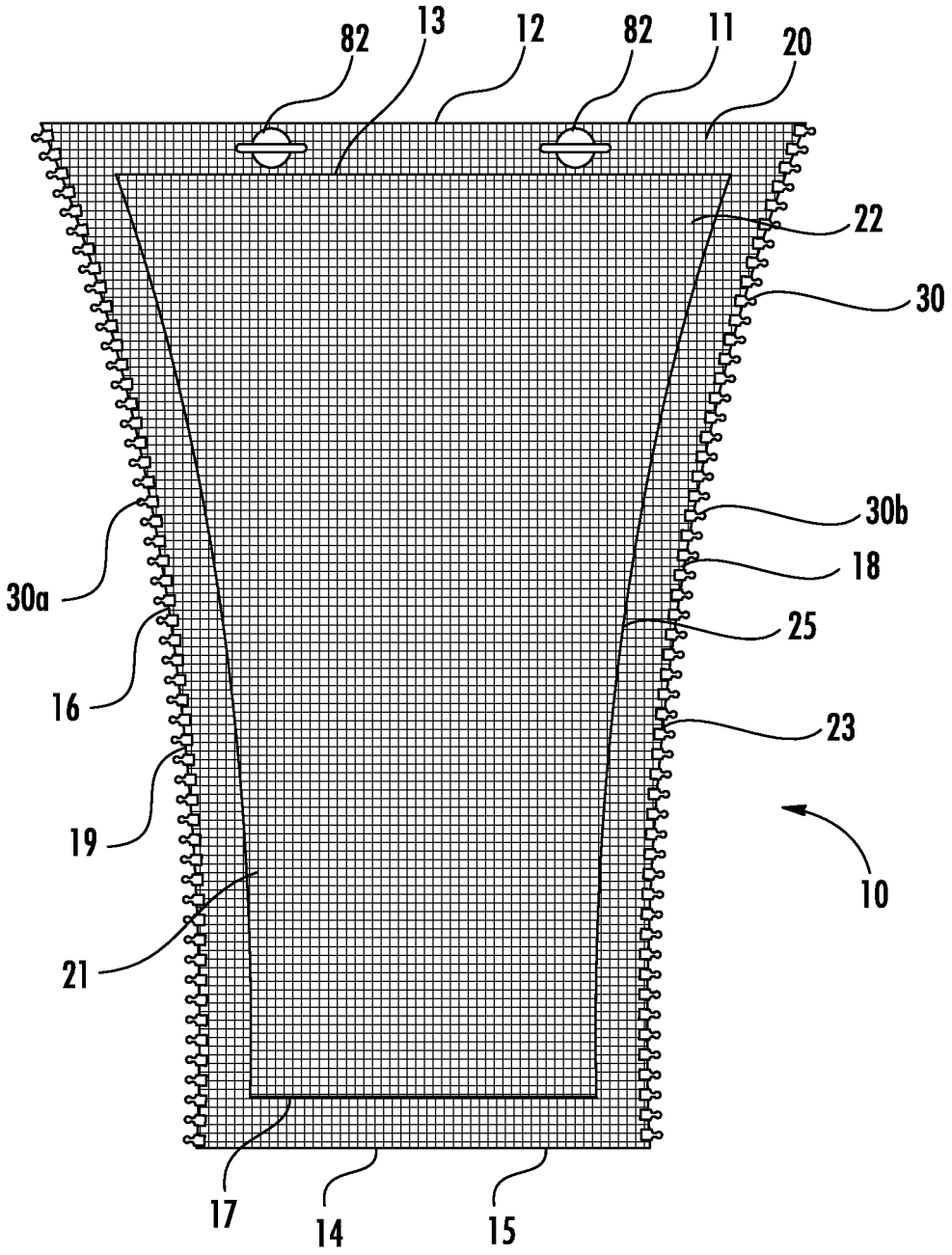
FIG. 3 is a top view of the inside of the present invention when unzipped and in its open (non-tubular) configuration.

FIGS. 1 and 2 depict an embodiment and a preferred embodiment of the present invention—a leg-covering garment 10. The leg-covering garment 10 has an upper edge portion 12, a lower edge portion 14 (basically parallel to upper edge portion 12) and a pair of opposed peripheral edge portions 16 and 18. The garment is made of preferably two layers of fabric—an exterior fabric 20 and an interior fabric 22. Both extend from their upper edges 11 and 13, respectively, to their lower edges 15 and 17, respectively (which, when sewn together, form the garment's upper edge portion 12 and lower edge portion 14). Similarly, first peripheral edge 16 is formed by sewing together the first peripheral edge 19 of the exterior fabric 20 to the first peripheral edge 21 of the interior fabric 22 and the second peripheral edge 18 is formed by sewing the second peripheral edge 23 of the exterior fabric 20 to the second peripheral edge 25 of the interior fabric 22. The actual size of the interior and exterior pieces of fabric are substantially the same, but for ease of illustration and understanding, the interior fabric is shown smaller, i.e., reduced or recessed on its sides (See FIG. 3) in the drawings. The exterior side and exterior fabric layer 20 of the garment 10 is shown in FIGS. 1 and 2. The interior side or interior fabric 22 of the garment 10 is shown in FIG. 3. Exterior fabric 20 is secured around its edges 11, 15, 19, and 23 to edges 13, 17, 21 and 25 of interior fabric 22 to form an integrated, multi-layered (at least two) garment—one for each leg. In one condition (and with a single zipper 30 unzipped and extending the entire length of the garment) as shown in FIGS. 1 and 3, the leg 10 is open or non-tubular. In the closed condition (with the zipper 30 zipped) as shown in FIG. 2, the garment 10 forms a tubular and tapered leg covering.

A thigh cuff 40 preferably is provided to the top or inside the fabric composite (or is defined by the top of the layers 20 and 22) and extends along the upper edge portions 11 and 13. It could be defined as a foldover section at the top of the garment, i.e., two layers of the garment folded over to define a cuff. The thigh cuff 40 is preferably elastic to be tight fitting around a user's thigh, but also easily stretchibly expandable for removal and comfort.

An ankle cuff 42 preferably is provided to the bottom or lower edges 15 and 17 of the fabric layers 20 and 22, respectively, and preferably does not need to be as elastic as the thigh cuff, but can be. The thigh cuff's elasticity helps to support the leg warmer up in position on the thigh of the wearer, as does the elasticity of the inner and outer fabric layers. The lower ankle cuff 42 is not as important for maintaining location, but, it too, should be elastically stretchable to maintain it in position and to retain warmth. The stretchiness of the thigh cuff 40 is likely greater than that of the ankle cuff 42. At relaxed (not stretched by the leg) positions, ankle cuff 42 is preferably smaller in circumferential length than the lower edge portions 15 and 17, respectively. The thigh cuff 40 may be slightly wider (or greater in circumferential length) than the upper edge portion 12 (comprised of exterior fabric's upper edge 11 and interior fabric's upper edge 13) to accommodate widening of the thigh as the thigh extends upwardly. A self-sizing elastic band can be used which would be less wide that the width of the upper edge portion 12, if desired. In one embodiment of the invention, the thigh cuff 40 can be formed as a single elastic band integrated into the top of the garment 10. In another embodiment of the invention, the thigh cuff 42 is comprised of multiple elastic bands, all to ensure a tight fit around the thigh of the wearer and to prevent accidental slippage. In another embodiment, the thigh cuff can have an elastic band provided, for example, with one or more button holes on an elastic band which can be suitably secured to a button or a pair of available buttons on the front side of the garment 10. This allows the wearer to pull on the band and slip the button hole over the button which closely provides the best combination of sizing, comfort and hold for the thigh cuff on the wearer's thigh.

The exterior fabric 20 and the interior fabric 22 are preferably sewn, joined (or fused or adhered together at least) along their edges, to form opposed first and second lateral or peripheral edges 16 and 18, defined by sewing edges 19 to 21 and 23 to 25 of the fabric layers 20 and 22, respectively. When the leg warmer is desirably converted to its tubular condition or shape (for wearing the same) a zipper 30, running along the peripheral edges 16 and 18, one or both opposed edges) secures and connects the opposed lateral edges 16 and 18 of the garment 10.

In one embodiment of the present invention, the zipper 30 is entirely separating, meaning it runs entirely the length of the garment from the upper edge 12 to the lower edge 14, with the zipper components 30*a* and 30*b*, running along the exterior fabric edges 19 and 23 or the interior fabric edges 21 and 25. This allows for the garment 10 to be fully separated for easy removal without requiring a user to remove her footwear. A zipper slide or pull 70 is also provided to facilitate the zipping up and down, i.e., the connection of the opposed edges 16 and 18 to form and un-form the tubular leg warmer 10. The open or flat condition of this one zipper-provided embodiment is shown in FIG. 1. One side or segment 30*a* of the zipper 30 runs along edge 16 (either secured to exterior first peripheral edge 19 or interior first peripheral edge 21 or both) and the interlocking set of teeth or other side or segment 30*b* of the zipper 30 run along the opposed edge 18 (either secured to exterior fabric's second peripheral edge 23 or interior fabric's second peripheral edge 25). A simple and conventional zipper slide or pull 70 is, of course, provided to either side or segment 30*a* or 30*b*, to accomplish zipper closing and opening. A second slide or pull can also be provided to allow for partial zipping and unzipping of the zipper 70, by drawing, pulling or sliding it along the zipper segments 30*a* and 30*b*. This second zipper slide would allow, for example, the zipper 30 to be partially open on either the top or the bottom (near upper edge portion 12 or lower edge portion 14, respectively, and, if both the zippers segments are moved towards one another their maximum allowance, it may even be possible for the garment to be slid off of and onto the leg of the wearer without fully opening up and releasing the edge portion 16 from the edge portion 18. In this embodiment of the invention, the zipper is considered fully separating in that the garment converts from a tubular condition, with zipper zipped, to a flat condition, with the zipper unzipped. This is a function, of course, of the zipper 30 extending fully from the bottom of the ankle cuff to the top of the thigh cuff.

In another embodiment, a single zipper 30 can extend from the ankle cuff up towards but not through the thigh cuff. Here, however, the elasticity and stretchiness of the thigh cuff is sufficient that with the zipper unzipped the garment can be easily donned and removed on the leg as the foot and shoe of the wearer can be passed through the stretched wide thigh cuff. This single zipper is considered partially separating in that when the zipper is fully unzipped, the garment cannot lay open and flat but, rather, at least some portion defines a closed tube.

In another embodiment of the present invention, two zippers are provided, each of which is partially-separating, thus again leaving a small amount of connected and tubular fabric intact. In this embodiment, an upper zipper segment 32 runs from thigh cuff 40 down, leaving below its open end a piece of tubular fabric not provided with a zipper, while the lower zipper 34 extends upwardly from ankle cuff 42 and lower edge 14 to below that defined tubular piece of fabric. The stretchiness of the tubular central section (and it can be located anywhere along the length of the garment from thigh cuff to ankle cuff can provide easy donning and removal of garment.

In the preferred embodiment, two zippers are provided neither of which extends fully for the length of the garment. One zipper extends up from the bottom of the ankle cuff and a second zipper extends downwardly from the top of the thigh cuff. The zippers are preferably vertically oriented but, here, the zippers are not aligned with one another and, indeed, the zipper 32 is 180 degrees around the leg covering garment 10 from the zipper 34 (as best seen in FIGS. 6-9). In this embodiment, the zipper 32 (provided with its own slide 72) extends downwardly from the top of the thigh cuff to just a little below the bottom of the thigh cuff 40. In this embodiment, the second zipper 34, extends from the bottom of the ankle cuff 42, upwardly, but substantially the entire distance of the overall height of the garment 10 but terminating, preferably, to just below the bottom of the thigh cuff 40. It, too, is provided with a slide element 74 for zipping closed and unzipping open the garment. As seen in the drawings, zipper 32 is relatively short in length or height while zipper 34 is relatively longer in length or height. In this embodiment, the bottom end 81 of the zipper 32 is located below the top end 83 of the zipper 34. Thus the two zippers 32 and 34 have an overlap, a function of the total length of the two zippers being greater than the length or height of the garment 10. In this embodiment, the opening of both zipper 32 and zipper 34, pulling their respective slides or pulls 72 and 74 toward one another, will define an opening and allow the foot of the wearer, with a shoe, to pass there through, allowing the wearer to easily don and remove the garment.

However, in another embodiment also using a partially-separating zipper, the single zipper 30 can extend from the ankle cuff 42 all the way up to the thigh cuff 40, or vice versa, i.e., span almost the entire length of the lateral edges 16 and 18 of the garment, with only the ankle cuff 42 or thigh cuff 40 not being able to be laid flat, i.e. retaining its tubular shape. In this embodiment, the thigh or ankle cuff, 40 or 42, respectively, and preferably thigh cuff 40, must be sufficiently stretchy to allow the leg warmer to be expanded (by pulling) over the foot (and shoe) of the wearer for removal and wearing.

In the preferred version of this embodiment, the thigh cuff 40 is the wider and stretchier portion of the garment 10 and, therefore, it is the zipper 34 which extends from the bottom of the ankle cuff 42 up to the bottom 44 of the thigh cuff 40. The stretchiness or elasticity of the thigh cuff allows the leg covering garment 10 to be easily pulled over the foot and shoe of the wearer, whether in trying to place the leg warmer/garment 10 on one's leg or in removing the same.

In an alternate embodiment, the tubular section (defined by the absence of the zipper segments i.e., in an embodiment where the zippers 32 and 34 do not overlap or cross one another) can be located at the knee and that tubular section at the knee can also be provided with sufficient stretch to allow the legwarmer to be easily placed over the knee and yet removed over the foot/shoe. Having one zipper 34 extend up from ankle cuff 42 to the lower section of the wearer's knee 62 and another zipper 32 (on the same side or 180 degrees around) extend down from thigh cuff 40 to top section of the wearer's knee 64 may make the leg covering garment 10 easier to don and remove than a single full length zipper.

FIG. 3 shows the interior fabric 22 of the leg-covering garment 10, while the garment is in its open and unzipped condition. Interior fabric 22 is preferably of a heavier or thermal but importantly more heat insulating material than exterior fabric 20, thus providing the added level of warmth for a user's legs when worn in the winter time. Preferably, the exterior fabric 20 and the interior fabric 22, even when sewn together to form an integrated or single, multi-layer composite, is not overly bulky nor should it provide visible thickness, when worn. Preferably, interior fabric 22 is a 4-way stretch fabric. It can be a stretch nylon blend and possibly include Spandex® as a stretch component. The interior fabric 22 is preferably of a denser material so that the exterior can still provide the attractive look of a pair of tights, allowing a user to wear such a garment to school or work, underneath a skirt, without looking unprofessional, while providing warmth. The exterior fabric can be non-stretchy or stretchy (of the same or dissimilar degree) as the interior fabric, and can be more fanciful, printed, water-proof, striped, etc. It could, of course, be the same as the interior fabric, i.e. of the same or different stretchiness and/or fabric design (or, as desired by the designer, the two could be inverted colors or complementary designs, for example). The inventive leg covering garment 10 can actually be comprised of visibly different exterior and interior fabrics 20 and 22, and also functionally different fabrics (stretchiness, thermal insulative qualities, etc.) so that the garment can even be selectively reversible allowing the wearer to decide on which fabric layer is to be worn closer to the skin and which fabric layer ought to be worn facing outwardly. In either situation, some level of thermal warmth and insulation is likely provided. The slide or pulls 70 of the zipper (or the slides 72 and 74 of the zippers 32 and 34, respectively) can be reversible, too.

Figure 4:
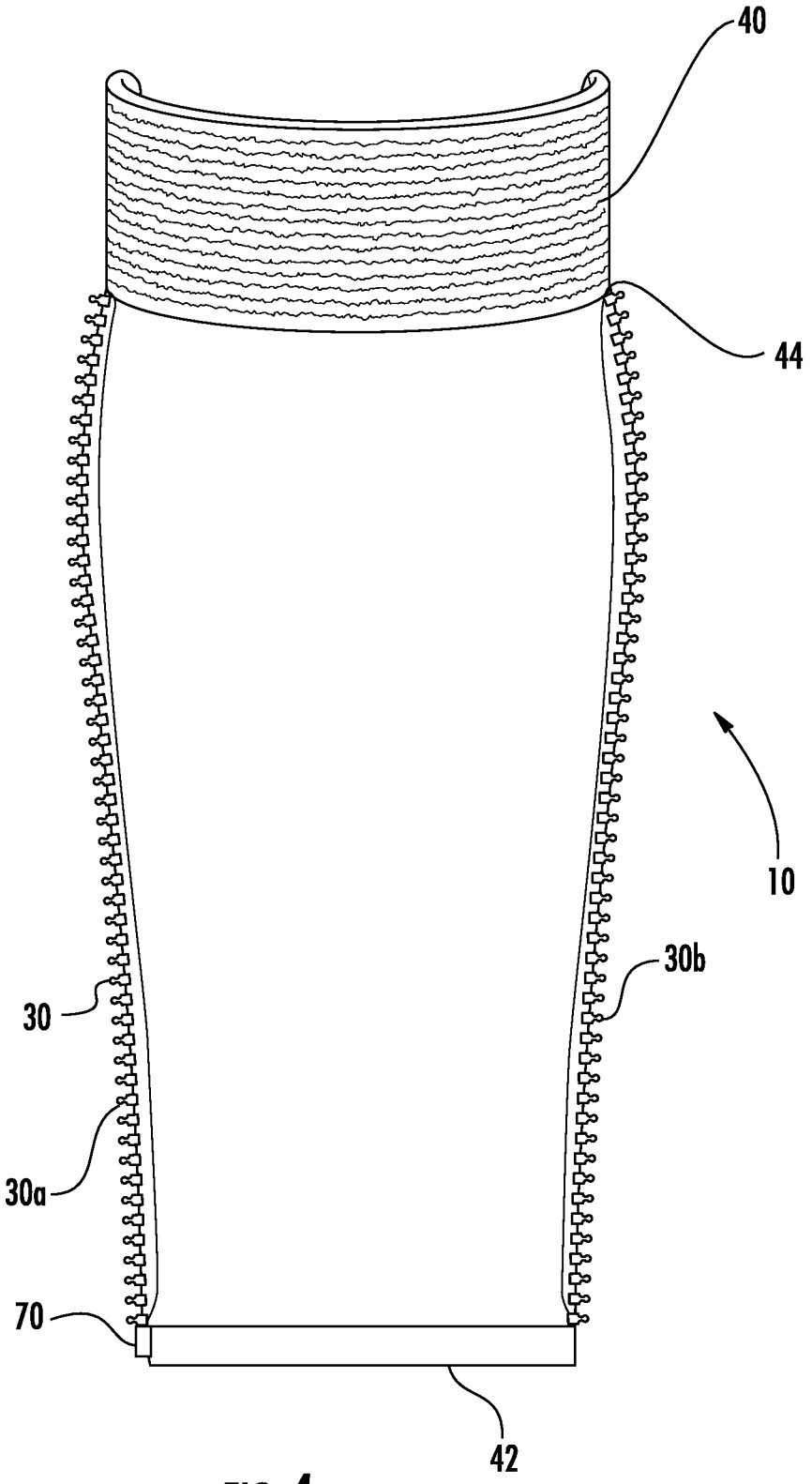
FIG. 4 is another top view of the structure of the present invention in its closed or zipped-up tubular configuration with multiple elastic bands provided for the thigh cuff instead of the interior and exterior fabric layers providing the stretchiness and elasticity to hold the leg warmer around the thigh.

FIG. 4 shows ankle cuff 42 and thigh cuff 40 of the present invention. Both are preferably located at the bottom and top edges 15 and 11, respectively, of the exterior fabric 20. Thigh cuff 40 can include an elastic band to maintain a form fit around a user's thigh while the garment 10 is being worn. Ankle cuff 42 can be formed by the interior fabric material 22 and/or the exterior fabric 20, or a separate extension thereof. The cuffs can include elastic bands or not, is single fabric thickness or more, and can be multi-layered as the bulk of the garment and can comprise foldover sections to form the cuffs, if desired. The zipper segments can terminate at the ends of the fabric layers and not extend to the elastic cuffs (in the case of the partially separating zipper embodiments). Or, the zipper can be continuous extending entirely through the cuff(s) (in the case of the fully separable zipper embodiment). The cuffs have enough elasticity to form fit around a user's thigh or ankle. These designs are implemented to maintain warmth while the garment is worn and to also be functional and attractive. In the preferred embodiment, the thigh cuff 40, in its relaxed position, has a circumferential length slightly less than upper edge portion 12 so as to be maintained fully within the exterior and interior fabrics 20 and 22, respectively and to hold the garment 10 up and upon the thigh of the wearer. Likewise, ankle cuff 42, in its relaxed state (i.e., when not stretched) has preferably a circumferential length less than lower edge 14 of the garment 10.

In FIG. 4, zipper 30 (comprised of two zipper segments 30*a* and 30*b*) is shown to be fully separating, extending (i.e., the zipper, not the direction of zipping or unzipping) up from the bottom of ankle cuff 42 to the top of thigh cuff 40. This easily allows the leg warmer 10 to be removed from and placed on a user's leg without removal of footwear.

Figure 5:
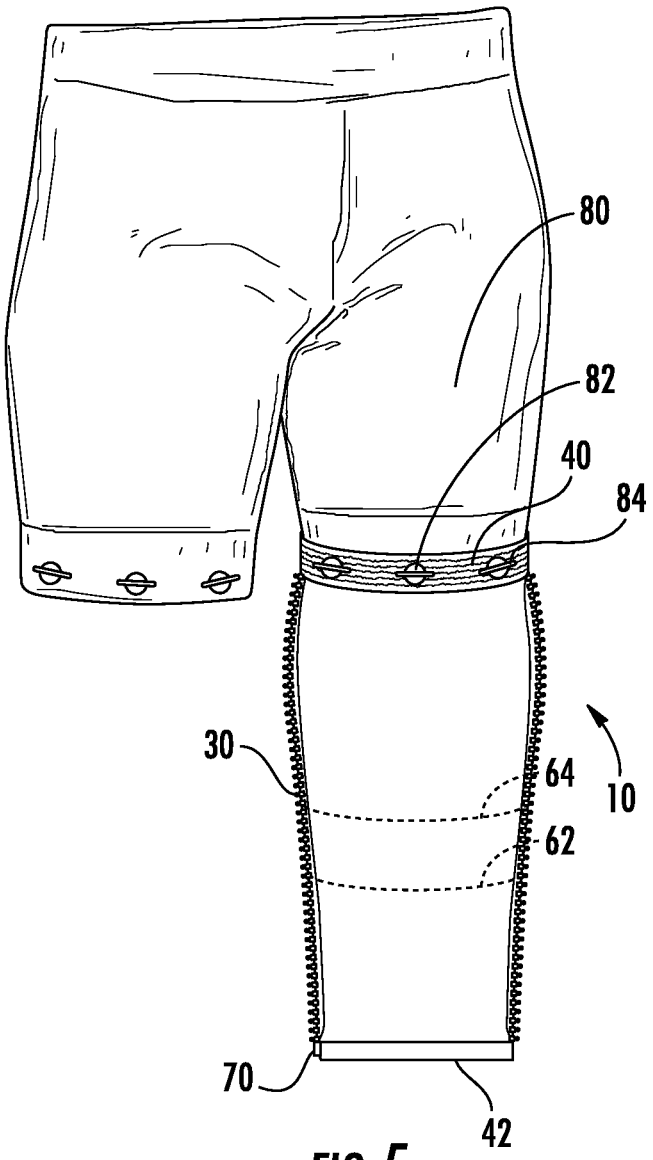
FIG. 5 is a front view of another embodiment of the present invention, a leg-warming and covering garment (only one leg warmer is shown attached) with the leg warmer connected to a pair of shorts as would be worn by a user.
Figure 6:
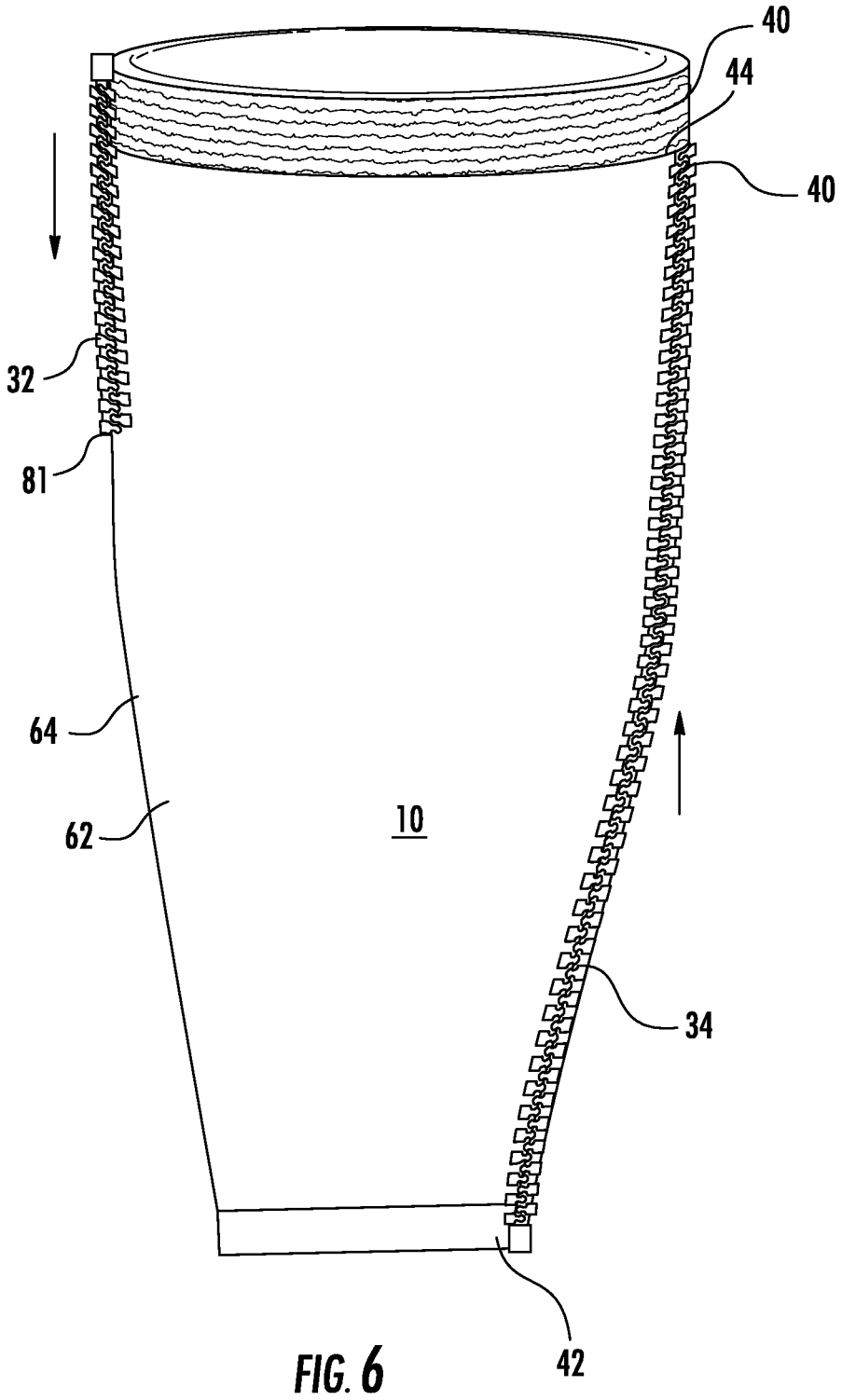
FIG. 6 is a top plan view of another embodiment of the present invention showing the replacement of a single full length (or height) zipper by a pair of opposed zippers. This shows the invention in its closed or tubular configuration as it would appear around the leg of the wearer.
Figure 7:
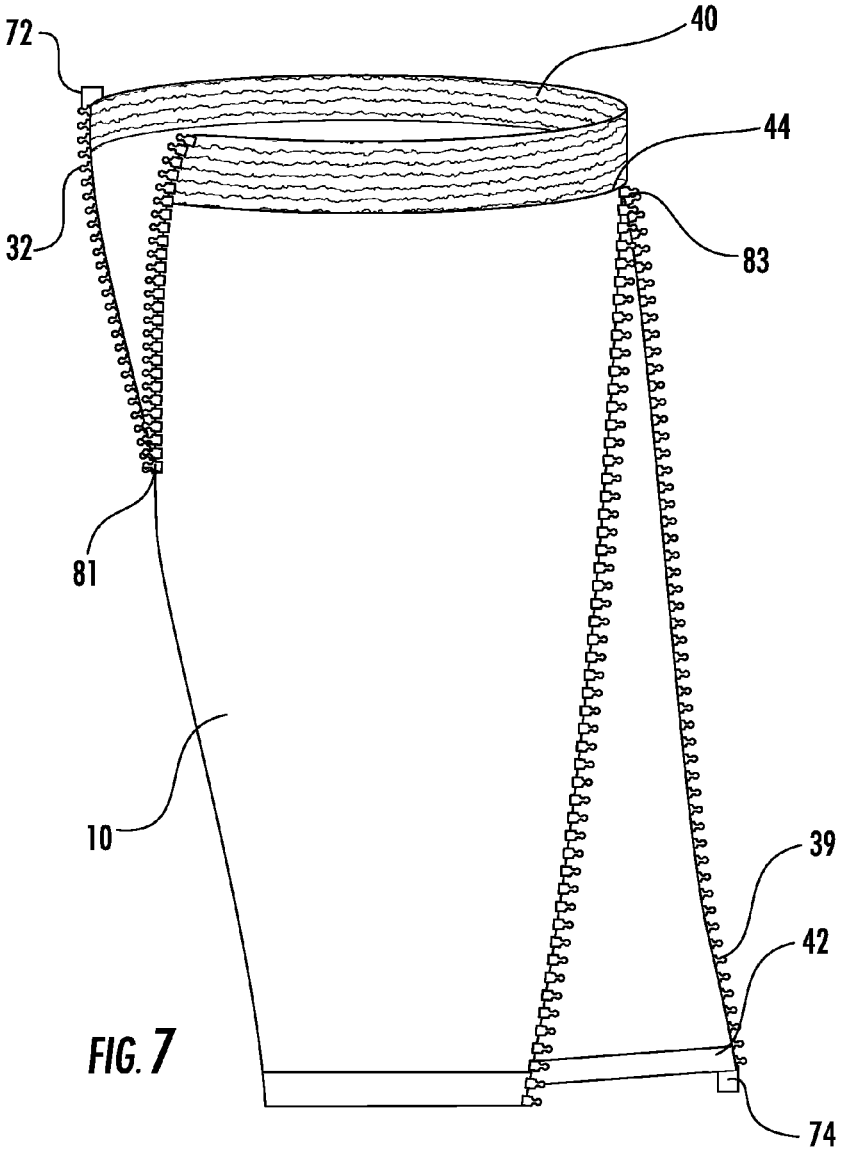
FIG. 7 is a top plan view of the embodiment of the invention shown in FIG. 6, with the two, opposed zippers being unzipped for allowing the easy donning and removal of the leg warmer.
Figure 8:
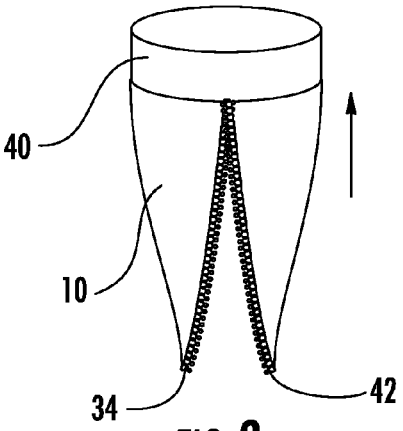
FIG. 8 is a side view of the invention shown in FIGS. 6 and 7, showing the side of the leg warmer where the ankle-originating zipper is unzipped upwardly towards the thigh elastic band.
Figure 9:
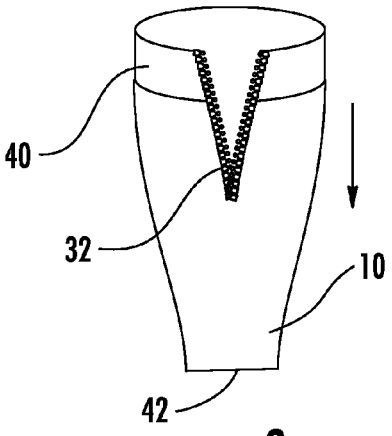
FIG. 9 is the other side view of the invention shown in FIGS. 6 and 7, i.e., 180 degrees around from that shown in FIG. 8, and shows the thigh-originating zipper unzipped and extending partially downwardly towards the ankle elastic band.

FIG. 5 depicts an alternate embodiment of the present invention, wherein the thigh cuff 40 is attached, by an attachment means (preferably button holes on the cuffs of the shorts and buttons at the thigh cuff of the garment 10) to a pair of shorts 80, preferably a composite formed from the same sewing together of exterior and interior fabric layers. While the shorts need not be double layer in thickness, they can be, of course. However, in this embodiment, a user can remove the leg warming portions of garments 10 from the shorts 80, by an attachment means connected to the top of thigh cuff 40 and the bottom of shorts 80, allowing a user to wear the shorts 80 underneath a skirt or dress even when the rest of the garments 10 have been removed. This allows a user to maintain warmth of their upper thighs and backside/pelvic area (above the thigh cuff) during cold weather, and to still remove the leg warmer 10 when indoors. Also, of course, the leg warmer 10 is useful without the shorts 80. In order to re-attach the leg warming garments 10, a user merely can zip the garments, connecting the opposed peripheral lateral edges 16 and 18 by zipper 30 (segments 30*a* and 30*b*) and connect the thigh cuff 40 to the bottom edge of the shorts 80 via the attachment means 82 (buttons 84 on the thigh cuff and button holes 86 on the bottom of the cuff of the shorts 80). The other embodiments of the inventive garments, with two zippers, can also, of course, be attached to the bottom cuff of the shorts and/or be worn by themselves, without the shorts 80.

In alternate forms and embodiments of the invention, the zippers, whether of the fully separating type or of the partially separating type can each have two pulls or slides so that the user can adjust the opening and closing of the zipper(s), as desired for warmth, comfort, etc.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed:

1. A leg warming article of apparel for a wearer comprising:

a multi-layer, integrated-together garment piece comprising:

an interior layer of elastic stretch and thermal insulating material which when flat defines a first pair of longitudinally opposed edges, a first top edge and a relative first bottom edge;

an exterior layer of knit material which when flat defines a second pair of longitudinally opposed edges, a second top edge and a relative second bottom edge;

said interior layer of elastic stretch and thermal insulating material and said exterior layer of knit material being sewn together about their respective said first and second pair of longitudinally opposed edges, first and second top edges and relative first and second bottom edges;

either said first pair of longitudinally opposed edges and/or said second pair of longitudinally opposed edges being provided with a first zipper such that closing said first zipper forms a tubular leg encircling and snug-to-the-leg article of apparel for a wearer, wherein one open end of said zipper extends to said first or said second bottom edges;

said first top edge and/or said second top edge and/or said exterior layer of knit material and/or said interior layer of elastic stretch and thermal insulating material being sufficiently stretchy to maintain the same tightly around the thigh of the wearer for holding the same up and on the leg when said zipper is closed; and a second and directionally opposed zipper, wherein said second and directionally opposed zipper is located out of vertical alignment with said first zipper and wherein said second and directionally opposed zipper extends downwardly from said first or said second top edge and only a short relative length of said article of wearing apparel.

2. A leg warming article of apparel for a wearer as claimed in claim 1 wherein said first zipper extends upwardly from said first or said second bottom edge and extends a substantial length but not all of the length of said article of wearing apparel.

3. A leg warming article of apparel for a wearer as claimed in claim 2 wherein the lengths of said first zipper and said second and directionally opposed zipper overlap along the length of said article of wearing apparel.

* * * * *